US006354177B2

(12) United States Patent
Peters

(10) Patent No.: US 6,354,177 B2
(45) Date of Patent: Mar. 12, 2002

(54) 6-IN-1 ROTARY TOOL

(75) Inventor: Michael P. Peters, Lutherville, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/792,958

(22) Filed: Feb. 26, 2001

Related U.S. Application Data

(60) Provisional application No. 60/185,797, filed on Feb. 29, 2000.

(51) Int. Cl.[7] ..... B25B 23/00

(52) U.S. Cl. ..... 81/439; 81/438; 81/177.4

(58) Field of Search ..... 81/438, 439, 490, 81/177.4

(56) References Cited

U.S. PATENT DOCUMENTS

| | | | | |
|---|---|---|---|---|
| 1,124,981 A | | 1/1915 | Weaver | |
| 1,805,005 A | | 5/1931 | Phillips | |
| 3,023,015 A | | 2/1962 | Pankow | |
| 3,114,401 A | * | 12/1963 | Johnson | 81/438 |
| 3,754,767 A | | 8/1973 | Bennett | |
| 3,841,646 A | | 10/1974 | Bennett | |
| 5,450,775 A | * | 9/1995 | Kozak | 81/490 |
| 5,470,180 A | * | 11/1995 | Jore | 408/239 R |
| 5,533,429 A | * | 7/1996 | Kozak | 81/438 |
| 5,586,847 A | | 12/1996 | Mattern, Jr. et al. | |
| 5,651,647 A | | 7/1997 | Ray | |
| 5,779,404 A | * | 7/1998 | Jore | 408/239 R |
| 5,894,765 A | * | 4/1999 | Anderson et al. | 81/439 |
| 5,904,080 A | * | 5/1999 | Anderson et al. | 81/439 |
| 6,053,675 A | * | 4/2000 | Holland et al. | 408/239 R |

FOREIGN PATENT DOCUMENTS

| | | |
|---|---|---|
| DE | G9307559.6 | 11/1993 |
| DE | 29607820 U1 | 9/1996 |
| GB | 2194476 A | 3/1988 |
| JP | 3-59163 | 3/1991 |
| JP | 5-5364 | 6/1993 |

* cited by examiner

*Primary Examiner*—Eileen P. Morgan
*Assistant Examiner*—Joni B. Danganan
(74) *Attorney, Agent, or Firm*—Harness, Dickey & Pierce, P.L.C.

(57) ABSTRACT

A rotary tool (10) is provided having a tool holder (16) including a socket (22) adapted to receive a reversible bit assembly (18). The bit assembly (18) having a storage cavity (44, 46) extending in each end. Each storage cavity (44, 46) adapted to receive a bit driver (54, 56) having a driver configuration (58, 60) formed on each end. Each driver configuration (58, 60), as well as the storage cavity (44, 46) and the socket (22) adapted to function as a drive member.

7 Claims, 1 Drawing Sheet

6-IN-1 ROTARY TOOL

CROSS-REFERENCE TO PRIORITY APPLICATION

This application claims priority under 35 USC §119(e) to United States Provisional Application No. 60/185,797 filed on Feb. 29, 2000. The disclosure of which is incorporated herein by reference.

BACKGROUND AND SUMMARY OF THE INVENTION

The present invention relates to a rotatable tool, and more specifically to a tool holder having a reversible bit assembly for providing six separate tool members.

When purchasing various rotary tools, professional tradesmen's and do-it-yourselfers are frequently required to purchase several of a series of tool or driver configurations that have different types of driving ends, e.g. Philips ®, Torx ® and flat head, as well as various hexangle nut driver configurations in metric and English units. The combinations of different tools for a given task may require the use of various different driving ends. Thus, the cost associated with having a complete set of tools is increased since each tool is generally sold separately. Moreover, there is a significant drawback for a user of many different tools and that the user must carry with him or her a specific tool for each task to be accomplished. For example, a user may need to bring multiple screw drivers and nut drivers to accomplish a single task. As a consequence, the user's tool belt or tool box soon becomes cluttered with these various implements resulting in an increase in the weight of the tools the user must carry from one location to another. Likewise, boaters, motorists, bicyclists, and homeowners have a need for a single multipurpose rotary tool that can be stored conveniently and compactly for use in an emergency or otherwise.

All of these developments have created a need for a single rotary tool that has a variety of functions and serves as a multiple rotary tool. However, this need has not been easily achieved. Hence, there exists a need for a single rotary tool and kit that functions as a multipurpose tool which can be stored and organized in a convenient manner and having the approximate size of a conventional single purpose rotary tool.

It is an object of the present invention to solve the variety of problems that exist in the art and to satisfy these and other needs.

Further areas of applicability of the present invention will become apparent from the detailed description provided hereinafter. It should be understood that the detailed description and the specific example set forth therein, while indicating the preferred embodiment of the invention, is intended for purposes of illustration only and is not intended to limited the scope of the invention, its application or uses.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
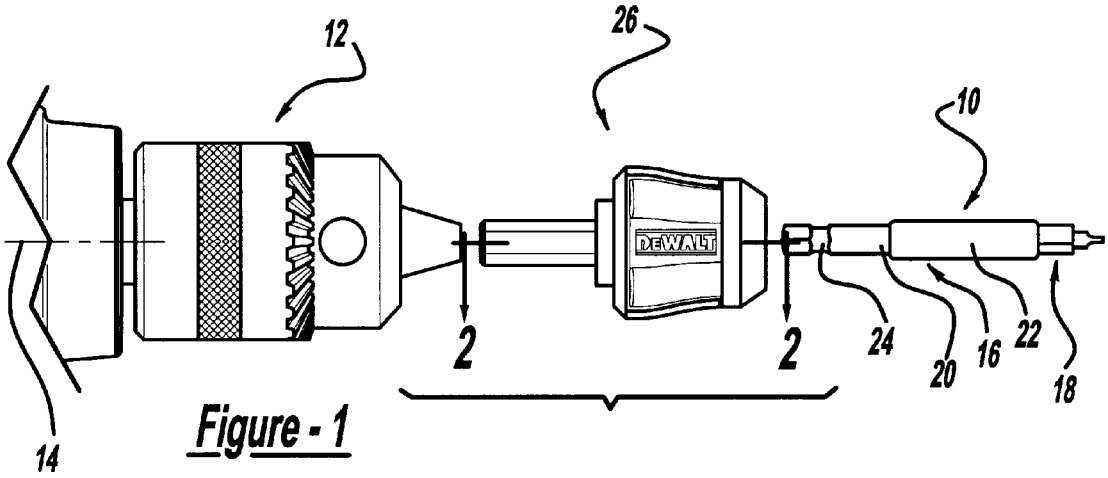
FIG. 1 is an exploded view illustrating the rotary tool of the present invention in association with a power tool having a keyless chuck or coupler interdisposed therebetween.

The present invention relates to a rotatable tool 10 that is connectable to a power tool 12 or simply a handle (not shown) for rotation about an axis 14. As is described in detail below, the rotatable tool 10 includes a tool holder 16 and a reversible bit assembly 18. The bit assembly 18 is releasably connectable to the tool holder 16, such as by spring biased detent balls, whereby the tool 10 provides six separate drivers for rotating a workpiece. In the preferred embodiment, the six drivers include four bit drivers and two nut drivers. The flexibility of the tool 10 with regard to the number of drivers as well as the tool being configured to allow rotation by a power tool or handle provides advantages not previously provided in the art.

Figure 2:
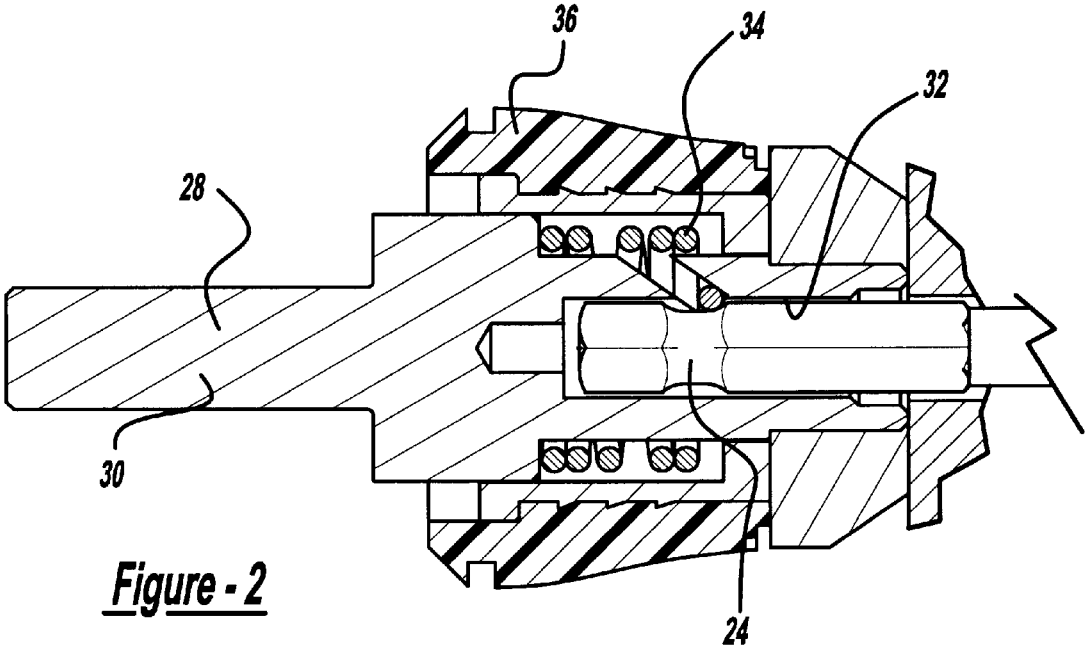
FIG. 2 is a cross-sectional view showing the inner coupling between the rotary tool and the coupler of the present invention.
Figure 3:
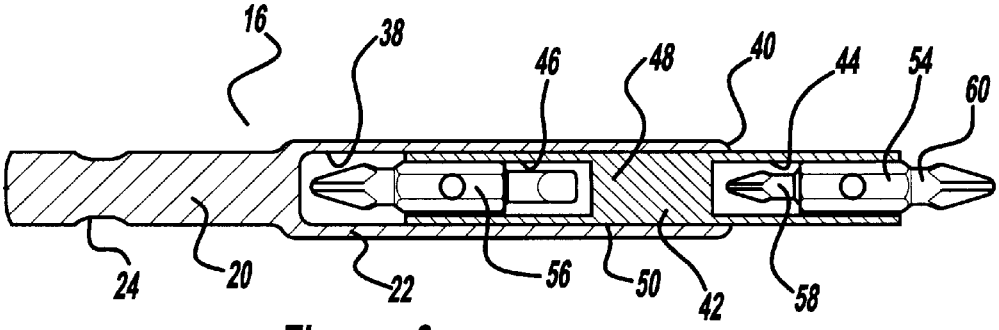
FIG. 3 is a cross-sectional view of the rotary tool in accordance with the present invention.

The tool holder 16 includes a shank 20 that is integral with, and that extends rearwardly from, a socket 22. The shank 20 is preferably hex-shaped and includes a circumferential groove 24. By this construction, the tool holder 16 is connectable to the drill or handle either directly or, most preferably, through a quick release coupler 26. The coupler 26 is generally illustrated in FIG. 2 to include a body 28, having a shaft 30 and an axial opening 32, a detent spring 34, and an actuating sleeve 36. The tool holder shank 20 is disposable in the opening 32 wherein the spring 34 engages the groove 24 to retain the shank 20 within the opening 32 for rotation with the coupler 26. A more detailed description of the coupler 26 is provided in the U.S. Pat. No. 6,053,675, issued Apr. 25, 2000, assigned to the assignee of the present application, and entitled "Quick-Acting Tool Bit Holder", the disclosure of which is hereby incorporated by reference.

The tool socket 22 includes a bore 38 that extends axially from socket end 40 and that is also preferably hex-shaped. The reversible bit assembly 18 includes a sleeve 42 having a pair of axial storage cavities 44 and 46 separated by a web 48. The outer surface 50 of the sleeve 42, each of the cavities 44 and 46, as well as a center section 52 of first and second bit drivers 54 and 56 are each again preferably hex-shaped such that each of the bit drivers 54 and 56 rotate with the sleeve 42 and socket 22. The configuration of a representative tool holder and bit assembly, including the socket, sleeve, and bit drivers, are illustrated and described in greater detail in U.S. Pat. No. 5,904,080, issued May 18, 1999 to Anderson et al. and entitled "8 in 1 Tool Bit Driver Hand Tool," the disclosure of which is hereby incorporated by reference.

In the preferred embodiment, each of the first and second bit drivers 54 and 56 are reversible within their respective cavities 44 and 46 such that either of the bit ends.58 or 60 can extend from sleeve 42. Additionally, the sleeve 42 is reversible within the socket bore 38 such that either the first or second bit drivers operably extend from the socket 22. Accordingly, the tool 10 may be configured such that any of the four bit driver ends operably project from the socket 22. Further, either of the bit drivers 54 and 56 may be removed from the sleeve to expose the hex-shaped cavity 44 or 46 for use as a nut driver. Finally, the tool's sixth driver is provided by removing the reversible bit assembly 18 from the socket bore 38 to expose the hex-shaped bore 38 for use as a second nut driver. It should be noted that bore 38 is larger than cavities 44 and 46 thereby drivably accommodating larger nuts. In the preferred embodiment, the bore is a 5/16 inch hex-opening while the cavities are each ¼ inch hex-openings.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A rotary tool comprising:

a tool holder including a socket and a shank, the socket having a first end, a second end, and an opening extending rearwardly from said first end toward said second end, the shank being integral with and extending rearwardly from said second end, said shank having a non-circular cross-section and a circumferential groove; and a reversible bit having a sleeve, a first reversible bit driver, and a second reversible bit driver, said sleeve including a first axial cavity, a second axial cavity, and a web separating said first and second axial cavities, said first bit driver disposed in said first axial cavity and coupled to rotate with the sleeve, said second bit driver disposed in said second axial cavity and coupled to rotate with the sleeve, said first and second axial cavities being of sufficient axial length to accommodate said first and second reversible bit drivers, and wherein said sleeve is disposed within said socket opening such that said sleeve rotates with the tool holder and one of said first and second bit drivers extends axially out of said opening.

2. The rotary tool of claim 1 wherein said socket defines a hexagonal 5/16-inch nut driver to rotate a workpiece.

3. The rotary tool of claim 1 wherein said first axial cavity defines a hexagonal ¼-inch nut driver to rotate a workpiece.

4. The rotary tool of claim 1 wherein said second axial cavity defines a hexagonal ¼-inch nut driver to rotate a workpiece.

5. A rotary tool comprising:

a tool holder including a shank and a socket, said shank being coupled for rotation with the socket and adapted to be coupled to a power driven rotary drive, said socket defining a first nut driver for rotating a workpiece; and a reversible bit including a sleeve defining a first cavity and a second cavity, a first bit driver having a first bit end and a second bit end, and a second bit driver having a first bit end and a second bit end, said first bit driver being selectively disposable within said first cavity for rotation with the sleeve in a first position where said first bit end extends from said sleeve and second position where said second bit extends from said sleeve, said second bit driver being selectively disposable within said second cavity for rotation with the sleeve in a first position where said first bit end of said second bit driver extends from said sleeve and a second position where said second bit of said second bit driver extends from said sleeve, said first bit driver being removable from said first cavity wherein said first cavity defines a second nut driver for rotating a workpiece, said first cavity being smaller than said socket.

6. The rotary tool of claim 5 wherein said socket and shank are of one-piece construction.

7. A tool assembly comprising:

a quick release coupler having a shank, a body, and a detent assembly, said shank adapted to be coupled to a handle or a power tool, said body defining a passage;

a tool holder having a shank and a socket, said shank being disposable in said passage and engaged by said detent assembly whereby said tool holder is coupled for rotation with the coupler; and a reversible bit having a sleeve, a first bit driver, and a second bit driver, said sleeve including a first axial cavity, a second axial cavity, and a web separating said first and second axial cavities, said first bit driver disposed in said first axial cavity and coupled to rotate with the sleeve, said second bit driver disposed in said second axial cavity and coupled to rotate with the sleeve, and wherein said sleeve is disposed within said socket opening such that said sleeve rotates with the tool holder and one of said first and second bit drivers extends axially out of said opening.

* * * * *